US011672310B2

(12) United States Patent
Stump et al.

(10) Patent No.: US 11,672,310 B2
(45) Date of Patent: Jun. 13, 2023

(54) ARTICULATING BUCKLE

(71) Applicant: CMC Rescue, Inc., Goleta, CA (US)

(72) Inventors: John Stump, Santa Barbara, CA (US); Tyler J. Mayer, Carpinteria, CA (US); Ole Kils, Goleta, CA (US); Ryan Schaafsma, Santa Barbara, CA (US)

(73) Assignee: CMC Rescue, Inc., Goleta, CA (US)

( * ) Notice: Subject to any disclaimer, the term of this patent is extended or adjusted under 35 U.S.C. 154(b) by 0 days.

(21) Appl. No.: 17/445,700

(22) Filed: Aug. 23, 2021

(65) Prior Publication Data

US 2022/0053888 A1 Feb. 24, 2022

Related U.S. Application Data

(60) Provisional application No. 63/069,501, filed on Aug. 24, 2020.

(51) Int. Cl.
*A44B 11/28* (2006.01)

(52) U.S. Cl.
CPC ..... *A44B 11/28* (2013.01)

(58) Field of Classification Search
CPC ... A44B 11/28; A44B 11/266; A44B 11/2588; F16B 45/022
See application file for complete search history.

(56) References Cited

U.S. PATENT DOCUMENTS

| | | | | |
|---|---|---|---|---|
| 6,802,109 | B2 * | 10/2004 | Hede | A44B 11/28 24/165 |
| 8,516,666 | B2 | 8/2013 | Hede | |
| 8,561,268 | B2 | 10/2013 | Hortnagl | |
| 2012/0012623 | A1 * | 1/2012 | Bergkvist | A44B 11/28 224/158 |
| 2019/0022436 | A1 * | 1/2019 | Emonin | A62B 35/0025 |

FOREIGN PATENT DOCUMENTS

EP 2944216 A1 11/2015

* cited by examiner

*Primary Examiner* — Robert Sandy
(74) *Attorney, Agent, or Firm* — McCoy Russell LLP

(57) ABSTRACT

An articulating buckle including a loop side and a hook side, the loop side configured to pivotably couple with the hook side via insertion of a cylindrical bar of the loop side into a rounded groove of the hook side. Coupling via the cylindrical bar and rounded groove enables the loop side to pivot relative to the hook side while the two sides are engaged. The articulating buckle further includes a first cam latch and a second cam latch, pivotably coupled to a base of the hook side, and configured to releasably secure the cylindrical bar within the rounded groove. The first cam latch includes a first lobe, and the second cam latch includes a second lobe, wherein the first lobe and the second lobe are configured to bias the first cam latch and second cam latch, respectively, towards a locked position, when acted against by the cylindrical bar.

10 Claims, 5 Drawing Sheets

100
102
104
106
110
112
114
115
120
121
122
124
128
132
133
134
136
140

ARTICULATING BUCKLE

CROSS REFERENCE TO RELATED APPLICATIONS

The present application claims priority to U.S. Provisional Application No. 63/069,501, entitled "ARTICULATING BUCKLE," filed on Aug. 24, 2020. The entire contents of the above-listed application are hereby incorporated by reference for all purposes.

FIELD

The present description relates generally to an articulating buckle comprising a loop side and hook side, wherein the loop side pivotably connects to the hook side by insertion of a bar of the loop side into a hook of the hook side, and wherein the cylindrical bar is secured within the hook by both a first cam latch and a second cam latch while the first cam latch and the second cam latch are in a locked position.

BACKGROUND/SUMMARY

Buckles are used in harnesses, clothing, backpacks, helmets, vehicle restraints etc. to join together pieces of webbing, cloth, rope, or fabric, to form a loop. Buckles provide a way for conveniently coupling and uncoupling two or more pieces of elongate material. However, the inventors herein have identified several issues with conventional buckles. First, conventional buckles create a rigid connection across the two halves of the buckle, causing the buckle to act as a single rigid body. This rigid body may be of a substantial length, and when used in a harness, belt, or other clothing application, may cause a pressure point when the rigid body is in contact with the rounded shape of a wearer's waist, arms, chest, legs, etc. This pressure point may cause the wearer discomfort. Further, the two halves of a conventional buckle may be engageable only while in a specific configuration, such that engagement of the two halves of a buckle may be impeded if the buckle is prevented from accessing the specific configuration. Further, it may generally be desirable to reduce a probability of unintentional disengagement of the two halves of the buckle.

In a first example, the above identified issues may be at least partially addressed by an articulating buckle comprising a loop side and a hook side, wherein the loop side is pivotably engageable with the hook side via an engagement element, such as a bar, and wherein a securing latch locks the loop side in pivotable engagement with the hook side while in a locked position. Engagement of the two halves of a buckle via a pivotable engagement means, as opposed to a rigid engagement as used in conventional buckles, may reduce rigidity in the buckle, thereby enabling the buckle to articulate/bend along the curve of a wearer's body, increasing comfort while simultaneously increasing the ease with which the wearer may engage or disengage the two halves of the buckle. Further, the buckle may articulate/bend in response to out-of-plane forces applied to the loop side and hook side, enabling the loop side and hook side to align with forces applied to thereto. This may reduce bending force acting on the buckle, thereby reducing wear of the buckle.

In a second example, the above identified issues may be at least partially addressed by an articulating buckle comprising a loop side comprising a cylindrical bar, and a hook side comprising a base, a hook comprising a rounded groove for engaging with the cylindrical bar, a first cam latch for securing the cylindrical bar within the hook, wherein the first cam latch is pivotably coupled to the base, and a second cam latch for securing the cylindrical bar within the hook, wherein the second cam latch is pivotably coupled to the base, wherein the first cam latch and the second cam latch secure the cylindrical bar within the hook while in a locked position, and wherein the hook side is pivotable about the cylindrical bar relative to the loop side while the cylindrical bar is engaged within the hook. By securing the cylindrical bar within the hook via both a first cam latch and a second cam latch, a probability of unintentional disengagement of the loop side of the articulating buckle from the hook side of the articulating buckle is reduced. Further, engagement of the loop side of the articulating buckle with the hook side of the articulating buckle via insertion of a cylindrical bar into a hook, enables the loop side of the buckle to pivot relative to the hook side of the buckle while the hook side and loop side are locked in engagement via the first cam latch and the second cam latch.

In a third example, the above identified issues may be at least partially address by an a method for an articulating buckle comprising, disengaging a loop side of the articulating buckle from a hook side of the articulating buckle by actuating a first cam latch and a second cam latch within the hook side of the articulating buckle from a locked position to an unlocked position by; pulling both a first release tab of the first cam latch and a second release tab of the second cam latch towards the loop side of the articulating buckle until both the first cam latch and the second cam latch are in an unlocked position, and lifting a cylindrical bar of the loop side from a hook of the hook side while maintaining the first cam latch and the second cam latch in the unlocked position. Wherein the loop side of the articulating buckle is pivotable about the cylindrical bar relative to the hook side of the articulating buckle while the loop side is engaged with the hook side. In this way, a probability of unintentional disengagement of the loop side of the articulating buckle from the hook side of the articulating buckle is reduced by enabling disengagement of the loop side from the hook side only upon actuation of both a first release tab and a second release tab. Further, by enabling the loop side to pivot relative to the hook side while the two halves of the articulating buckle are locked in engagement, the articulating buckle may reduce a probability of pressure point formation on a wearer, increasing wearer comfort, while maintaining coupling between two or more pieces of material in a harness, helmet, backpack, or article of clothing.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
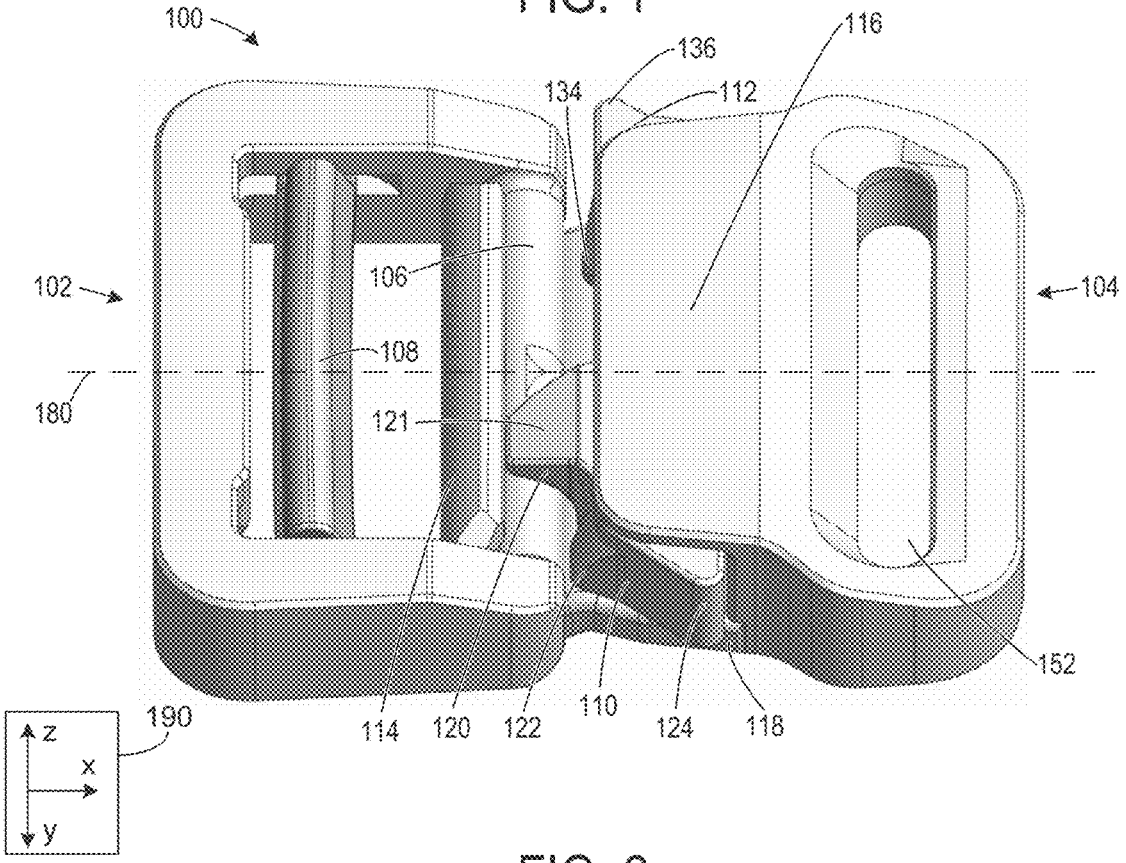
FIG. 1 shows a perspective view of an embodiment of an articulating buckle.
Figure 2:
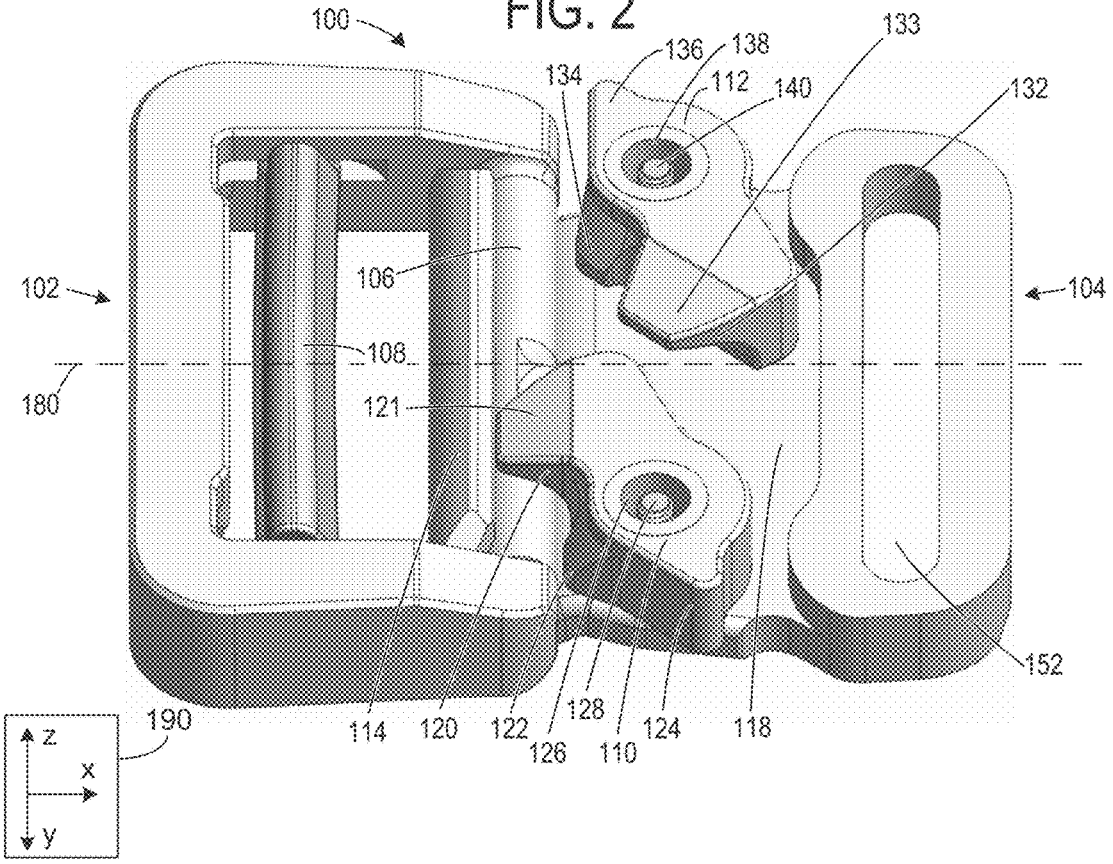
FIG. 2 shows a perspective view of an embodiment of an articulating buckle with a cover removed to more clearly illustrate the first cam latch and the second cam latch.
Figure 3:
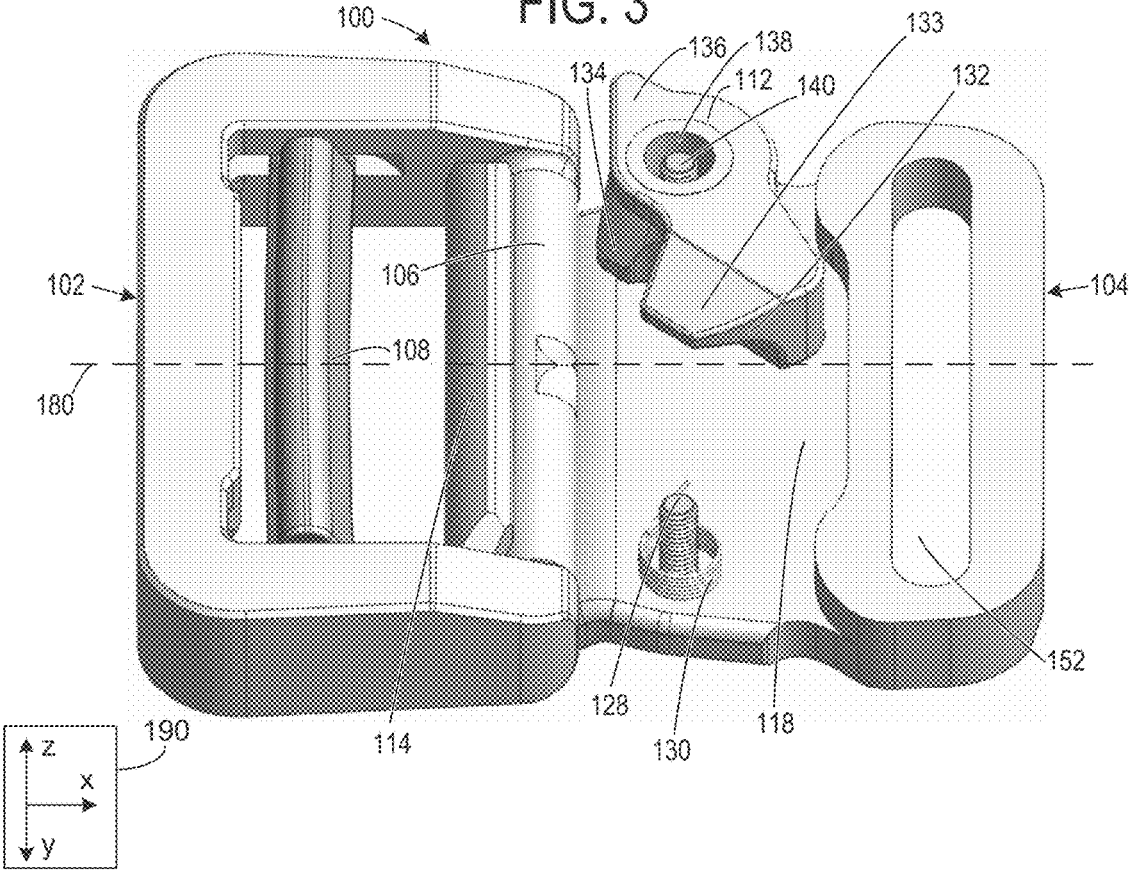
FIG. 3 shows a perspective view of an embodiment of an articulating buckle with a cover and the first cam latch removed, to more clearly illustrate the first fastener and first spring.
Figure 4:
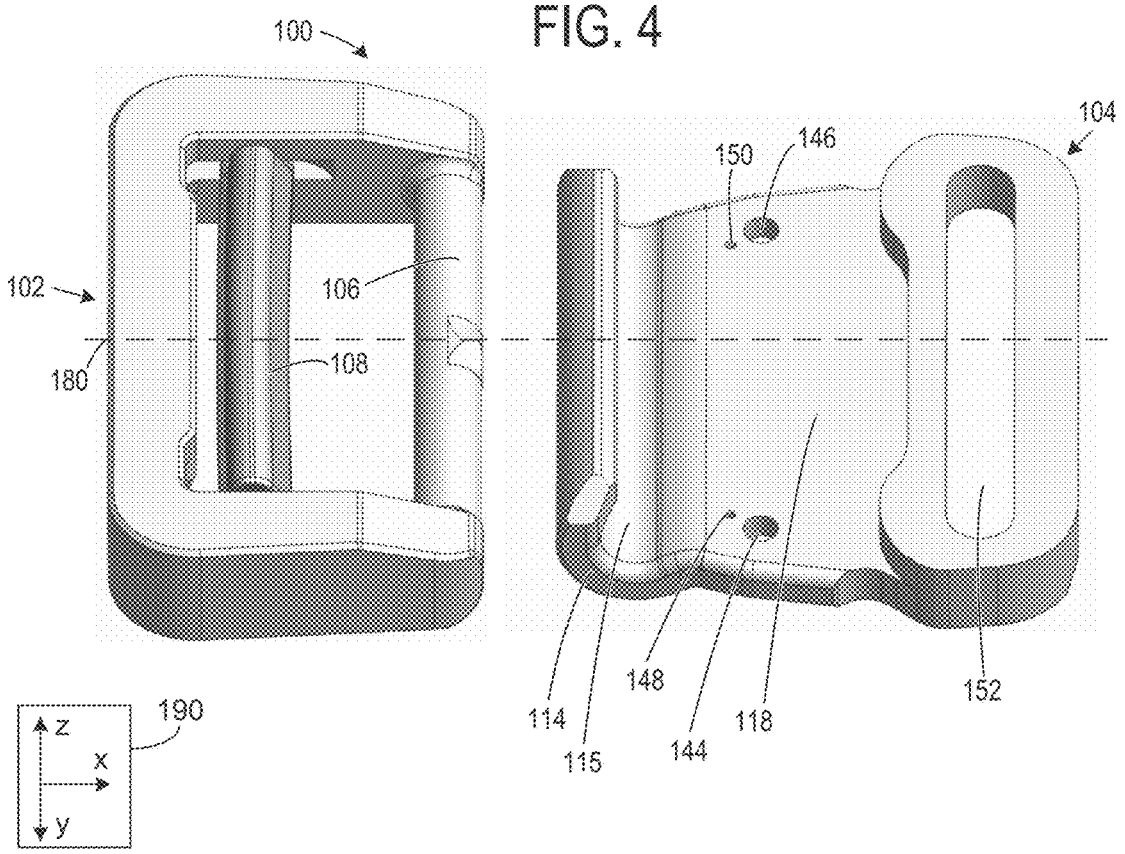
FIG. 4 shows a perspective view of an embodiment of an articulating buckle with components removed to more clearly illustrate the base of the hook side of the articulating buckle.
Figure 5:
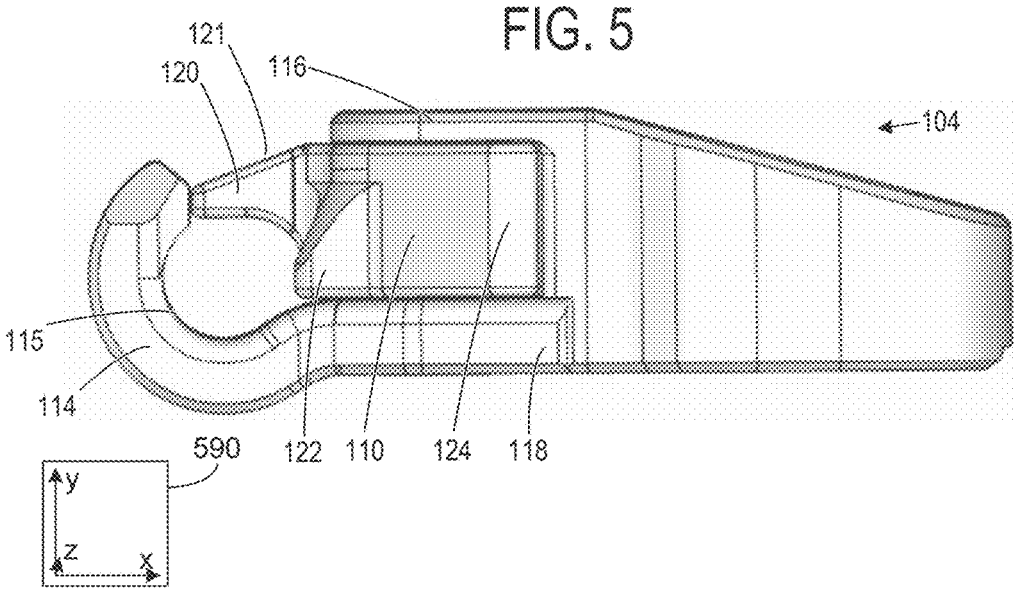
FIG. 5 shows a perspective view of a hook side of an articulating buckle from a different angle than that of FIGS. 1-4.

The following description relates to an articulating buckle and methods of operating the articulating buckle. The articulating buckle herein disclosed may comprise a loop side and a hook side, wherein the loop side is pivotably engageable with the hook side via an engagement element, such as a straight or curved bar having a circular, square, or other cross section, and wherein a securing element such as a latch secures the loop side in pivotable engagement with the hook side while in a locked position. FIG. 1 shows a first embodiment of an articulating buckle 100, comprising a loop side 102 and a hook side 104 pivotably engaged with each other, wherein the engagement element of articulating buckle 100 comprise a straight cylindrical bar 106 of the loop side 102 and a hook 114, having a rounded groove 115, of the hook side 104. The securing latch of articulating buckle 100 comprises both a first cam latch 110 and a second cam latch 112, wherein both the first cam latch 110 and the second cam latch 112 may be independently actuated from a locked position, to an unlocked position, and wherein engagement and/or disengaged of the loop side 102 and the hook side 104 necessarily comprises actuating both the first cam latch 110 and the second cam latch 112 to the unlocked position. FIG. 2 shows articulating buckle 100 with cover 116 removed to more clearly illustrate first cam latch 110 and second cam latch 112. FIG. 3 shows articulating buckle 100 with cover 116 and first cam latch 110 removed to more clearly illustrate first fastener 128 and first spring 130, wherein first fastener 128 pivotably couples first cam latch 110 to base 118, and first spring 130 resiliently biases cam latch 110 towards the locked position. FIG. 4 shows loop side 102 and hook side 104 in a disengaged conformation, with all subcomponents of hook side 104 removed to more clearly illustrate base 118. FIG. 5 shows a side view of hook side 104, which more clearly illustrates rounded groove 115 in hook 114, as well as the relative positions of first latch 120 and first lobe 122. FIGS. 6-9 show a closer view of first cam latch 110 from a variety of different angles. FIG. 10A-10D illustrates actuations of an articulating buckle from a disengaged conformation to an engaged conformation via substantially a single movement. FIG. 11 emphasizes the force produced by second lobe 134 on second cam latch 112, when in contact with cylindrical bar 106, which causes a torque on second cam latch 112 in the direction of the locked position.

The articulating buckle disclosed herein may reduce a wearer's discomfort by enabling the buckle to more closely fit the contour of a wearer's body, while simultaneously reducing a probability of unintentional disengagement of the loop side and the hook side, by providing both a first cam latch and a second cam latch securing the cylindrical bar within the hook, wherein disengaging the cylindrical bar from the hook necessarily comprises actuating both the first cam latch and the second cam latch to an unlocked position. Further, the first cam latch comprises a first lobe, and the second cam latch comprises a second lobe, wherein both the first lobe and the second lobe produce a torque/rotational force on the first cam latch and the second cam latch, respectively, when acted against by the cylindrical bar, wherein the torque/rotational force is in the direction of the locked position. In this way, movement of the cylindrical bar towards the first and/or second cam latches results in a net torque on said cam latches towards the closed/locked position.

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that one or more components referred to as being "substantially similar and/or identical" differ from one another according to manufacturing tolerances (e.g., within 1-5% deviation). Axis systems, such as axis system 190, may be included in one or more figures disclosed herein. The direction indicated by the arrow associated with an axis of the axis system may be referred to herein as the positive direction of the specified axis, while the direction opposite the direction indicated by the arrow of an axis is referred to as being in the negative direction of the specified axis. For example, the x-axis of axis system 190 points to the right (as viewed face on), and as such, movement in the rightward direction may be referred to as movement in the positive-x-direction, while contrastingly, movement in the leftward direction may be herein referred to as movement in the negative-x-direction. The same convention is used herein with regards to the y-axis, and the z-axis.

Turning first to FIG. 1, articulating buckle 100 is shown. Articulating buckle 100 is one example of an articulating buckle according to the current disclosure, and is intended to be used for illustration purposes, not limitation. It will be appreciated that the components of articulating buckle 100 may comprise one or more of aluminum, carbon fiber, magnesium, plastic, steel, iron, or a combination thereof. Articulating buckle 100 is shown next to an axis system 190 comprising three axes, namely an x-axis parallel to a horizontal direction, a y-axis parallel to a vertical direction, and a z-axis perpendicular to each of the horizontal and vertical directions is shown.

Articulating buckle 100 comprises two halves, a first half, herein referred to as loop side 102, and a second half, herein referred to as hook side 104. The loop side 102 and hook side 104 are pivotably engageable with each other by an engagement element, wherein it will be appreciated that engagement element may comprise other configurations than those shown in articulating buckle 100. Further, loop side 102 and hook side 104 may be locked in pivotable engagement by a securing element, wherein it will be appreciated that the securing element may comprise configurations other than those shown in articulating buckle 100. The securing element may be actuated from a locked position, wherein engagement and disengagement of the loop side 102 and hook side 104 is inhibited, to an unlocked position, wherein engagement and disengagement of loop side 102 and hook side 104 is enabled. Further, articulating buckle 100 is bilaterally symmetrical about a plane running through longitudinal axis 180 and parallel with the y-axis. Components of articulating buckle 100 in the negative z-direction relative to longitudinal axis may have corresponding, mirrored components in the positive z-direction relative to longitudinal axis 180.

Loop side 102 comprises cylindrical bar 106 and loop bar 108. Cylindrical bar 106 comprises a straight cylindrical bar with a circular profile (as viewed along the z-axis), wherein the circular profile of cylindrical bar 106 provides a conformal surface between cylindrical bar 106 and hook 114, enabling smooth pivoting/rotation of cylindrical bar 106 within hook 114. Cylindrical bar 106 may include a protrusion positioned half way down the length (along the z-axis) of cylindrical bar 106 (where longitudinal axis 180 intersects cylindrical bar 106) which may inhibit sliding in the positive and negative z directions relative to hook side 104 while cylindrical bar 106 is engaged, and locked, within hook 114. The protrusion may comprise a raised section of cylindrical bar 106 between first cam latch 110 and second cam latch 112 configured to limit an extent of rotation, and sliding, of cylindrical bar 106. In one example, the protrusion may comprise a protrusion with a tapered pyramidal shape. In another example, the protrusion may comprise an abrupt, circular profiled section of cylindrical bar 106, extending beyond an outer diameter of cylindrical bar 106.

Loop bar 108, which in one example comprises an adjustable bar with a non-circular profile, slideable within a groove of loop side 102, may be used to adjustably attach loop side 102 to a first piece of webbing, fabric, cloth, etc. (not shown). The non-circular profile of loop bar 108 may enable greater friction against an inserted piece of webbing or other material than may be provided by a bar with a circular profile, inhibiting sliding or disengagement of the material from loop side 104. Similar to loop bar 108, hook side 104 comprises base attachment loop 152, which may be used to attach hook side 104 to a second piece of webbing, fabric, cloth, etc. (not shown). Base attachment loop 152 may comprise an oblong passage or opening through base 118 of hook side 104, through which an elongated piece of material, such as webbing, cloth, fabric, etc., may be inserted. Engagement and disengagement, also herein referred to as coupling and decoupling, of loop side 102 with hook side 104, correspondingly enables coupling and decoupling of the first piece of webbing, fabric, cloth, etc. from the second piece of webbing, fabric, cloth, etc. In one example, a user may secure a harness by engaging loop side 102 with hook side 104.

Loop side 102 may be pivotably engaged with hook side 104 by inserting cylindrical bar 106 of loop side 102 into hook 114 of hook side 104 via an opening of hook 114. Hook 114 comprises a rounded groove 115 (not shown in FIG. 1), comprising a penannular groove with an opening running the full length of hook 114 which enables cylindrical bar 106 to pass into and out of rounded groove 115 (when the opening is not occluded/blocked by the first latch 120 and/or second latch 132). The rounded groove 115 comprises an inner surface having a circular curvature matching a circular curvature of cylindrical bar 106, wherein an outer surface of cylindrical bar 106 is in face sharing contact with all or part of an inner surface of rounded groove 115 while cylindrical bar 106 is inserted into hook 114. The diameter of rounded groove 115 is equal or larger than a diameter of cylindrical bar 106, thereby enabling cylindrical bar 106 to fit within rounded groove 115. Once cylindrical bar 106 is inserted into hook 114, the outer surface of cylindrical bar 106 may slide relative to an inner surface of rounded groove 115, enabling loop side 102 to pivot about cylindrical bar 106. Egress of cylindrical bar 106 from hook 114 may be inhibited by first cam latch 110 and/or cam latch 112.

Hook side 104 further comprises base 118, and cover 116, wherein first cam latch 110 and second cam latch 112 are pivotably mounted between base 118 and cover 116 by first fastener 128 (not shown in FIG. 1) and second fastener 140 (not shown in FIG. 1), respectively. First fastener 128 and second fastener 140 couple base 118 to cover 116 and provide axes of rotation about which first cam latch 110 and second cam latch 112 may pivot, enabling the first cam latch 110 and the second cam latch 112 to transition from the locked position to the unlocked position by rotating about first fastener 128 and second fastener 140, respectively. In the embodiment shown in FIG. 1, first fastener 128 and second fastener 140 comprise two threaded fasteners inserted into an under side (opposite from the side occupied by cover 116) of hook side 104, which pass through a first base fastener receiving hole 148 (not shown in FIG. 1), a first fastener receiving hole 126 (not shown in FIG. 1) of the first cam latch 110, and a second base fastener receiving hole 150, and a second fastener receiving hole 138 (not shown in FIG. 1) of the second cam latch 112. The threaded portion of the first fastener 128 and the threaded portion of the second fastener 140 engages cover 116, thereby coupling base 118 and cover 116, and securing first cam latch 110 and second cam latch 112 in pivotable engagement with hook side 104. In some examples, first fastener 128 and second fastener 140 may comprise rivets, bolts, cylindrical protrusions extending from either base 118 or cover 116.

First cam latch 110 comprises a first latch 120, having a first outer surface 121, wherein the first latch 120 is configured to inhibit passage of cylindrical bar 106 into, or out of, hook 114. First cam latch 110 further comprises a first release tab 124, protruding from an outward facing side of hook side 104. First release tab 124 comprises a rounded triangular knob or switch, which enables a user to actuate first cam latch 110 from a locked position to an unlocked position, using one or more fingers. In one example, first release tab 124 may be of a shape other than that shown in FIG. 1. In one example, a user may pull (or push) first release tab 124 away from base attachment loop 152 towards loop side 102, which may cause first cam latch 110 to pivot about a central axis of first fastener 128, causing first latch 120 to move into a recess between base 118 and cover 116, out of the opening of hook 114, thereby enabling egress of cylindrical bar 106 out of, or insertion of cylindrical bar 106 into, hook 114. First cam latch 110 may be resiliently biased towards the locked position, such that in the absence of external force, or physical blockage, first cam latch 110 may return to the locked position shown in FIG. 1.

First cam latch 110 further comprises a first lobe 122, which, when first cam latch 110 is in the locked position (as shown in FIG. 1), is offset from an axis of rotation of first cam latch 110 (wherein the axis of rotation comprises a central axis of first fastener 128), as viewed along longitudinal axis 180. Specifically, as viewed along longitudinal axis 180 in the direction of base attachment loop 152, first lobe 122 is offset to the right (further away from longitudinal axis 180) as compared to the axis of rotation of first cam latch 110. The offset between the first lobe 122 and the axis of rotation of first cam latch 110 results in a rotational force (torque) towards the locked position being produced by first lobe 122 in first cam latch 110 when first lobe 122 is acted against by cylindrical bar 106 (e.g., as cylindrical bar 106 moves away from hook 114), while cylindrical bar 106 is engaged with hook 114. This rotational force, towards the locked position reduces a probability that collision between cylindrical bar 106 and first cam latch 110 may cause rotation of first cam latch 110 to the unlocked position. In this way, first lobe 122 may reduce a probability of unintentional disengagement of cylindrical bar 106 from hook 114.

Second cam latch 112 comprises a second latch 132, having a second outer surface 133, wherein the second latch 132 is configured to inhibit passage of cylindrical bar 106 into, or out of, hook 114 while second cam latch 112 is in the locked position. Second cam latch 112 further comprises a second release tab 136, protruding from an outward facing side of hook side 104, opposite the side from which first release tab 124 protrudes. Second release tab 136 comprises a rounded triangular knob or switch, which enables a user to actuate first cam latch 110 from a locked position to an unlocked position, using one or more fingers. In one example, a user may actuate both first release tab 124 and second release tab 136 using a thumb and index finger of a single hand. In one example, second release tab 136 may comprise shapes other than that shown in FIG. 1. In one example, a user my pull (or push) second release tab 136 away from base attachment loop 152 towards loop side 102, which may cause first cam latch 110 to pivot about a central axis of second fastener 140, causing second latch 132 to move into a recess between base 118 and cover 116, out of the opening of hook 114, thereby enabling egress or insertion of cylindrical bar 106 into, or out of, hook 114. Second cam latch 112 may be resiliently biased towards the locked position, such that in the absence of external force, or physical blockage, second cam latch 112 may return to the locked position. Second cam latch 112 is shown in the unlocked position in FIG. 1, wherein second latch 133 is within a recess of hook side 104, and is not occluding the opening of hook 114.

Second cam latch 112 further comprises a second lobe 134, which, when second cam latch 112 is in the locked position (such as that shown by first cam latch 110 in FIG. 1), is offset from an axis of rotation of second cam latch 112 (wherein the axis of rotation comprises a central axis of second fastener 140), as viewed along longitudinal axis 180. Specifically, as viewed along longitudinal axis 180 in the direction of base attachment loop 152, second lobe 134 is offset to the left (further away from longitudinal axis 180) of the axis of rotation of second cam latch 112 when in the locked position. The offset between the second lobe 134 and the axis of rotation of second cam latch 112 results in a rotational force (torque) towards the locked position being produced by second lobe 134 in second cam latch 112 when second lobe 134 is acted against by cylindrical bar 106 (e.g., as cylindrical bar 106 moves away from hook 114), while cylindrical bar 106 is engaged with hook 114. This rotational force, towards the locked position reduces a probability that collision between cylindrical bar 106 and second cam latch 112 may cause rotation of second cam latch 112 to the unlocked position. In this way, second lobe 134 may reduce a probability of unintentional disengagement of cylindrical bar 106 from hook 114.

Articulating buckle 100, as shown in FIG. 1, is locked in an engaged conformation, wherein loop side 102 is locked in pivotable engagement with hook side 104 by first cam latch 110 (note, second cam latch 112 is in an unlocked position, however cylindrical bar 106 remains locked in pivotal engagement with hook 114 so long as one or more cam latches are in a locked conformation). While locked in pivotable engagement, loop side 102 may pivot about a central axis of cylindrical bar 106 (wherein the central axis of cylindrical bar 106 runs longitudinally through the center of cylindrical bar 106, parallel to the z-axis as shown in FIG. 1) relative to hook side 104, thereby enabling articulating buckle 100 to bend/pivot/articulate at the point of engagement between loop side 102 and hook side 104 and conform more closely to a wearer's body, which may reduce discomfort and enable easier engagement and disengagement of the loop side 102 and hook side 104. In one example, loop side 102 may have a pivotable range of 60 degrees relative to hook side 104 (that is, loop side 102 may pivot in a range of 30 degrees above to 30 degrees below a plane occupied by hook side 104). In another example, loop side 102 may have a pivotable range of 180 degrees relative to hook side 104. In another example, loop side 102 may have a pivotable range between 60 degrees and 180 degrees relative to hook side 104.

Turning to FIG. 2, an alternate view of articulating buckle 100 is shown. Cover 116 is omitted in FIG. 2 to more clearly display the structure and arrangement of first cam latch 110 and second cam latch 112. It will be understood that this is done for illustration purposes only and does not indicate omission of cover 116 from the embodiment of the articulating buckle 100 shown in FIG. 2. Elements which were previously introduced and discussed in FIG. 1 have retained the same numbering in FIG. 2, and are only briefly discussed in the description of FIG. 2. Similar to FIG. 1, FIG. 2 includes axis system 190, which comprises three axes, an x-axis parallel to a horizontal direction, a y-axis parallel to a vertical direction, and a z-axis perpendicular to each of the horizontal and vertical directions.

FIG. 2 shows loop side 102 pivotably engaged with hook side 104 through the engagement mechanism comprising cylindrical bar 106 and hook 114. Cylindrical bar 106 is locked within hook 114 by first cam latch 110, while second cam latch 112 is in the unlocked position. Disengagement of cylindrical bar 106 from hook 114 necessarily comprises actuating both the first cam latch 110 and the second cam latch 112 to their respective unlocked positions using first release tab 124 and second release tab 136, prior to removal/disengagement of cylindrical bar 106 from hook 114 via the opening of hook 114. By providing dual independently actuable cam latches, a probability of unintentional disengagement of cylindrical bar 106 from hook 114 is reduced. First cam latch 110 and second cam latch 112 are symmetrical about longitudinal axis 180, and therefore features of first cam latch 110 are also present in second cam latch 112, although in a mirrored arrangement (that is, features on the left of first cam latch 110 are on the right of second cam latch 112, actuation of first cam latch 110 from the locked position to the unlocked position includes clockwise rotation about first fastener 128, while actuation of second cam latch 112 from the locked position to the unlocked position includes counter-clockwise rotation about second fastener 140, and so on).

Omission of cover 116 in FIG. 2 enables viewing of second cam latch 112, which is in the unlocked position recessed within hook side 114. Further, omission of cover 116 exposes first fastener receiving hole 126 in first cam latch 110, which comprises a circular bore/hole through first cam latch 110, enabling insertion of first fastener 128. Similarly, omission of cover 116 exposes second fastener receiving hole 138 in second cam latch 112, which comprises a circular bore/hole through second cam latch 112, enabling insertion of second fastener 140.

Actuation of first cam latch 110 to the unlocked position (not shown in FIG. 2) comprises clockwise rotation of the first cam latch 110 about first fastener 128, wherein first fastener 128 is inserted into first fastener receiving hole 126, which causes first latch 121 to move away from the opening of hook 114 and recede within a recess formed within hook side 104 between cover 116 and base 118. In one example, actuation of first cam latch 110 to the unlocked position comprises a 45 degree clockwise rotation of first cam latch 110 about first fastener 128. Similarly, actuation of second cam latch 112 to the unlocked position comprises counter-clockwise rotation of the second cam latch 112 about second fastener 140, wherein second fastener 140 is inserted second fastener receiving hole 138, which causes first latch 132 to move away from the opening of hook 114 and recede within a recess formed within hook side 104 between cover 116 and base 118. In one example, actuation of second cam latch 112 to the unlocked position comprises a 45 degree counter-clockwise rotation of second cam latch 112 about second fastener 140. The range of rotation of both first cam latch 110 and second cam latch 112 towards the unlocked position may be bounded by a ledge/back wall of the recess between cover 116 and base 118, which may act as a stop by physically blocking further rotation of first cam latch 110 and/or second cam latch 112.

First latch 120 and second latch 132 are configured such that, while in the locked position, an offset exists between the center of first fastener 128 and first outer surface 121 and between the center of second fastener 140 and second outer surface 133, such that downward force against first surface 121 and second outer surface 133 produces a torque on first cam latch 110 and second cam latch 112 in a direction of the unlocked position, thereby enabling cylindrical bar 106 to be inserted into hook 114, in substantially a single actuation. In other words, both the first latch 110 and second latch 112 may be actuated to the unlocked position by pressing cylindrical bar 106 downwards (in the negative y-direction) against first outer surface 121 and second outer surface 133. It will be appreciated that first outer surface 121 and second outer surface 133 may in some embodiments be curved, and are not limited to planar embodiments.

Turning to FIG. 3, articulating buckle 100 is shown with first cam latch 110 and cover 116 omitted to further illustrate internal components of articulating buckle 100. It will be understood that omission of first cam latch 110 and cover 116 is done for illustration purposes, and does not indicate omission of the one or more components from the embodiment of the articulating buckle 100 shown in FIG. 3. In particular, omission of first cam latch 110 enables viewing of first spring 130, wherein first spring 130 may comprise a torsion spring configured to resiliently bias first cam latch 110 towards the locked position, such that actuation of first cam latch 110 away from the locked position may result in displacement of first spring 130, resulting in generation of a restorative torque on first cam latch 110 in the direction of the locked configuration. Similarly, second cam latch 112 comprises a second spring 142, configured to resiliently bias the second cam latch 112 towards the locked position.

Turning to FIG. 4, articulating buckle 100 is shown in a disengaged conformation, with cover 116, first cam latch 110, second cam latch 112, first fastener 128, second fastener 140, first spring 130, and second spring 142 omitted to more clearly illustrate the components of base 118. Specifically, FIG. 4 shows first base fastener receiving hole 144 and first base spring receiving hole 148 (along with corresponding second base fastener receiving hole 146 and second base spring receiving hold 150). First base fastener receiving hole 144 comprises a circular hole/bore in base 118 through which a portion of first fastener 128 may pass. First fastener 128 may comprise a flange or other terminal expansion of a wider outer diameter than first base fastener receiving hole 144, thereby inhibiting the flange or terminal expansion from passing through first base fastener receiving hole 144. First base spring receiving hole 148 comprises a hole/bore through base 118 into which an end of first spring 130 may be inserted, thereby fixing one end of first spring 130 to base 118.

Similarly, second base fastener receiving hole 146 comprises a circular hole/bore in base 118 through which a portion of second fastener 140 may pass. Second fastener 140 may comprise a flange or other terminal expansion of a wider outer diameter than second base fastener receiving hole 146, thereby inhibiting the flange or terminal expansion from passing through second base fastener receiving hole 144. Second base spring receiving hole 150 comprises a hole/bore through base 118 into which an end of second spring 142 may be inserted, thereby fixing one end of second spring 142 to base 118.

Further, FIG. 4 shows rounded groove 115, within hook 114, into which cylindrical bar 106 may be inserted by passing through a tope opening of hook 114. The inner surface of rounded groove 115 comprises a smooth, rounded surface, having a curvature matching the curvature of cylindrical bar 106, such that cylindrical bar 106 may reside concentrically within rounded groove 115 when engaged. The length of rounded groove 115 in the z-direction is less than the length of cylindrical bar 106 (also in the z-direction), enabling both terminal ends of cylindrical bar 106 to protrude out of opposite circular openings of rounded groove 115. In addition to the opening of rounded groove 115 opening towards the positive y-direction, into which cylindrical bar 106 may inserted or removed, rounded groove 115 comprises a first circular opening and a second circular opening, wherein the first circular opening is located on a first side of the hook side 104, and wherein the second circular opening is located on a second side, opposite the first side (with respect to the z-axis) of hook side 104. Both cylindrical bar 106 and rounded groove 115 may have a straight central axis running parallel to the z-axis, when the loop side 102 and hook side 104 are engaged, the central axis of cylindrical bar 106 and the central axis of rounded groove 115 may overlap, and further, loop side 102 may pivot relative to hook side 104 about the overlapping central axes of cylindrical bar 106 and rounded groove 115.

Turning to FIG. 5, a side view of hook side 104 of articulating buckle 100 is shown. Hook side 104 is shown next to an axis system 590, wherein the x-axis extends horizontally from left to right (parallel with the top and bottom of the page), the y-axis extends vertically from the bottom to the top of the page (parallel to the left and right hand edges of the page), while the z-axis extends into and out of the page, perpendicular to the x-axis and y-axis. The perspective view of FIG. 5 emphasizes the penannular shape of hook 114.

As shown in FIG. 5, first cam latch 110 is in the locked position, wherein first latch 120 occludes the top opening (the opening in the positive y-direction) of hook 114. The profile of hook 114 in the x-y plane illustrates the semicircular or penannular curvature of rounded groove 115. In one example, the x-y profile of inner surface of rounded groove 115 (as shown in FIG. 5) occupies 270 degrees of curvature, with 90 degrees of opening, wherein cylindrical bar 106 may engage with rounded groove 115 by passing through the 90 degree opening. The center of curvature of rounded groove 115, may, when loop side 102 and hook side 104 are pivotable engaged, act as the axis of rotation about which loop side 102 may pivot relative to hook side 104.

The profile of first latch 120 in the x-y plane comprises a wedge or triangular extension/protrusion from the main body of first cam latch 110 in the negative x-direction. The slope of outer surface 121, which comprises an approximately 30 degree angle relative to the x-axis, enables a downward force acting thereon to produce a clockwise torque in first cam latch 110 (as viewed from above). In one embodiment, first outer surface 121 and second outer surface 131 may comprise curved surfaces, wherein a radius of curvature of said curved surfaces may vary in one or more directions. In one example, a downward motion of a rigid object, such as cylindrical bar 106, against first outer surface 121, causes first latch 120 to slide along the rigid object, causing first cam latch to pivot towards the open position. Contrastingly, the first undersurface of first latch 120 (the side of first latch 120 opposite the first outer surface) comprises a surface substantially parallel to the x-axis, which may prevent upward (positive y-direction) motion of cylindrical bar 106 engaged inside rounded groove 115 from actuating the first cam latch 110 to the unlocked position. In other words, the configuration of first latch 120 (and similarly, the configuration of second latch 132) is such that cylindrical bar 106 may engage with hook 114 by inserting into rounded groove 115 through substantially a single actuation, wherein first cam latch 110 (and second cam latch 112, not shown) pivot to the unlocked position, away from the opening of hook 114, as cylindrical bar 106 presses down (negative y-direction) against the first outer surface 121 (and second outer surface 133). Conversely, disengagement of cylindrical bar 106 may not be achieved in substantially a single actuation, as the undersurface of first latch 120 (and similarly the undersurface of second latch 132) are not configured to enable cylindrical bar 106 to push the first cam latch 110 and the second cam latch 112 into the unlocked conformation from upward force (positive y-direction) produced by contact with cylindrical bar 106. In other words, upward force acting on the undersurface of first latch 120 may not translate to force in the positive x-direction, as the slope of the undersurface of first latch 120 relative to the x-axis is insubstantial.

While in the locked position, first cam latch 110 may be bounded in its pivotal range by contact with hook 114. Specifically, as first spring 130 produces a torque on first cam latch 110 in the direction of the locked conformation, in the absence of other forces, first cam latch 110 may pivot counter-clockwise (as viewed from above) until first latch 120 makes contact with a surface of hook 114. In one example, the contact point of first latch 120 and hook 114 may comprise complimentary geometry, such as a tongue and groove. In another example, the contact region between first latch 120 and hook 140 may comprise two normal surfaces, such that the force produced by first spring 130 is not deflected in the positive or negative y directions (as viewed in FIG. 5).

Figure 6:
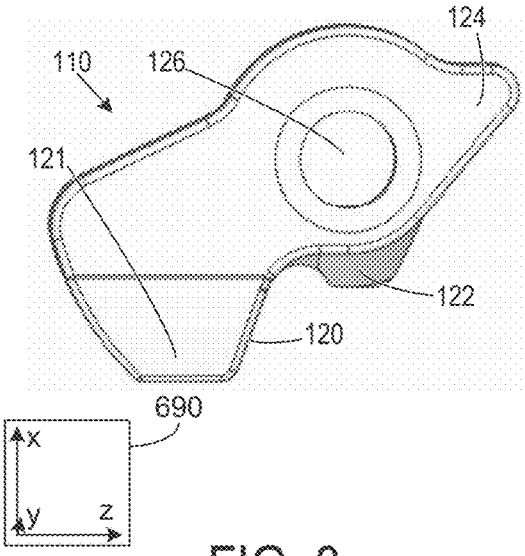
FIG. 6 shows a perspective view from a first angle of an embodiment of a cam latch.

FIG. 6 shows a top view of first cam latch 110 (that is, a view of the surface of first cam latch 110 closest to cover 116 in articulating buckle 100). It will be appreciated that first cam latch 110 and second cam latch 112 comprise mirror images of each other, and therefore the description of first cam latch 110 and its features may be applied to second cam latch 112 and its features after taking into account the effect of mirroring on the direction of rotation and the relative positioning/arrangement of features. FIG. 6 includes axis system 690, wherein axis system 690 is substantially similar to axis system 590.

As shown in FIG. 6, first cam latch 110 comprises first release tab 124, which comprises a triangular protrusion, with rounded edges, as viewed in the x-y plane of FIG. 6. The first release tab 124 is configured to enable a user to easily pivot first cam 110 about its rotational axis (the center of first fastener receiving hole 126) from a locked position, to an unlocked position. Comparing first latch 120 with first lobe 122, it may be seen that first lobe 122 comprises a smaller x offset from the center of first fastener receiving hole 126, and a smaller y direction protrusion, than first latch 120.

Figure 7:
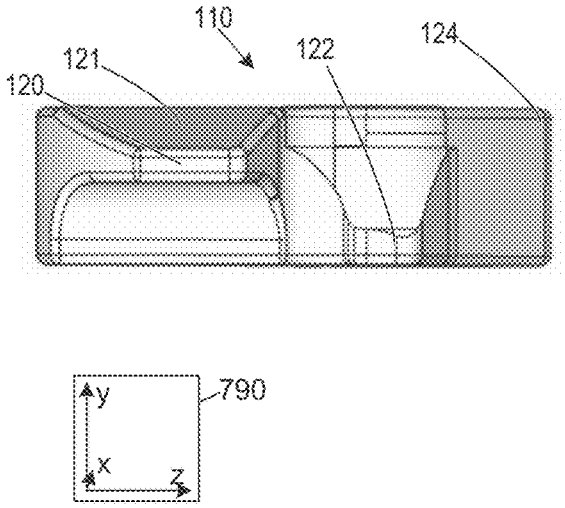
FIG. 7 shows a perspective view from a second angle of an embodiment of a cam latch.

Turning to FIG. 7, a front view of first cam latch 110 is shown (wherein the front of first cam latch 110 comprises the portion of first cam latch 110 facing hook 114 while in the locked position. FIG. 7 includes axis system 790, which is substantially similar to axis system 590. The perspective view of first cam latch 110 shown in FIG. 7 emphasizes the relative arrangement of first latch 120 and first lobe 122. First latch 120 is shown as having a sloping top surface (first outer surface 121) while having a substantially flat/planar undersurface. The width of first latch 120 (that is, the length in the x-direction, as shown in FIG. 7), tapers as a function of distance away from the main body of first cam latch 110.

Figure 8:
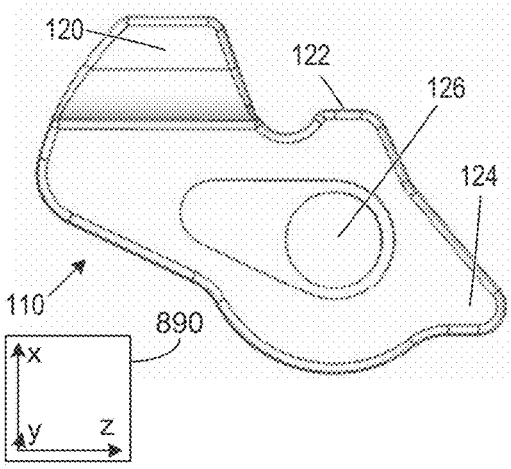
FIG. 8 shows a perspective view from a third angle of an embodiment of a cam latch.

Turning to FIG. 8, a view of the undersurface of first cam latch 110 is shown (that is, a view of the surface of first cam latch 110 proximal to cover 118 in articulating buckle 100). FIG. 8 includes axis system 890, which is substantially similar to axis system 590. The view of first cam latch 110 shown in FIG. 8 shows the recess within the underside of first cam latch 110, contiguous with first fastener receiving hole 126, into which first spring 130 resides in articulating buckle 100. The extent of the recess in the negative x-direction enables first spring 130 to act at a sufficient lever moment to produce a torque in first cam latch 110 towards the locked position, when first cam latch 110 is rotated away from the locked position.

Figure 9:
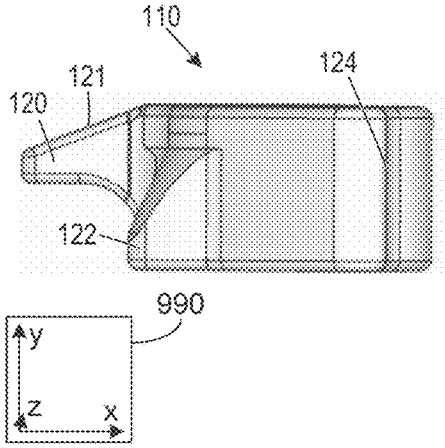
FIG. 9 shows a perspective view from a fourth angle of an embodiment of a cam latch.

Turning to FIG. 9, a view of the outer side of first cam latch 110 is shown (that is, a view of the side of first cam latch 110 facing away from longitudinal axis 180 in articulating buckle 100). FIG. 9 includes axis system 990, which is substantially similar to axis system 590. The perspective view of first cam latch 110 shown in FIG. 9 emphasizes the relative placement of first latch 120 compared to first lobe 122, particularly, first lobe 122 is positioned toward a bottom surface of first cam latch 110 (that is, toward the side of first cam latch 110 which is in face sharing contact with base 118 in articulating buckle 100), while first latch 120 is positioned toward a top surface of first cam latch 110 (that is, toward a surface of first cam latch 110 which is proximal to cover 116 in articulating buckle 100).

FIGS. 10A-10D depict articulating buckle 100 transitioning from a disengaged conformation to an engaged conformation, by pressing cylindrical bar 106 against first outer surface 121 and second outer surface 133. Each of FIGS. 10A-10D includes both a side view of articulating buckle 100 as well as a top view of hook side 104, with cover 116 shown as being transparent to more clearly illustrate the position of first cam latch 110 and second cam latch 112 during the engagement process. It will be appreciated that cover 116 is shown as transparent for illustrative purposes, and does not limit the disclosure to articulating buckles comprising optically transparent covers. Elements which were previously introduced and discussed in FIGS. 1-9 retain the same numbering in FIGS. 10A-10D.

Figures 10A, 10B, 10C, 10D:
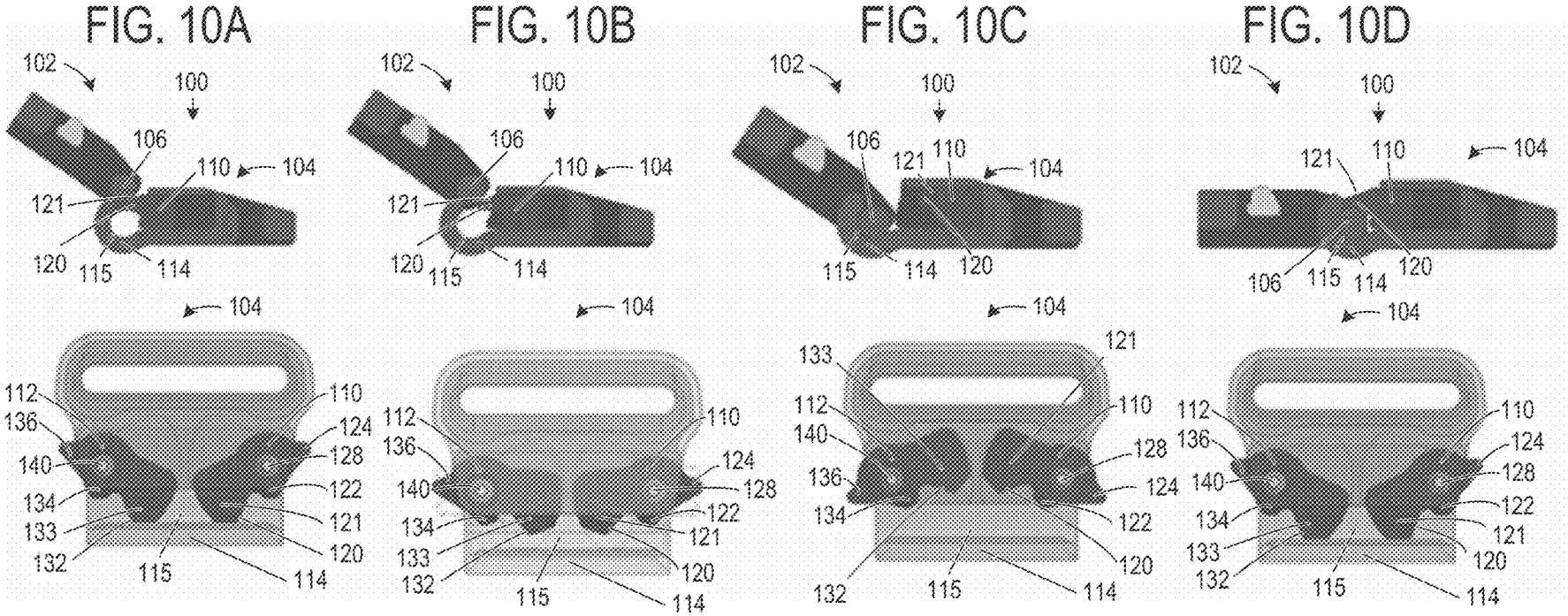
FIGS. 10A, 10B, 10C, and 10D show an embodiment of an articulating buckle being actuated from a disengaged position to an engaged position.
Figure 11:
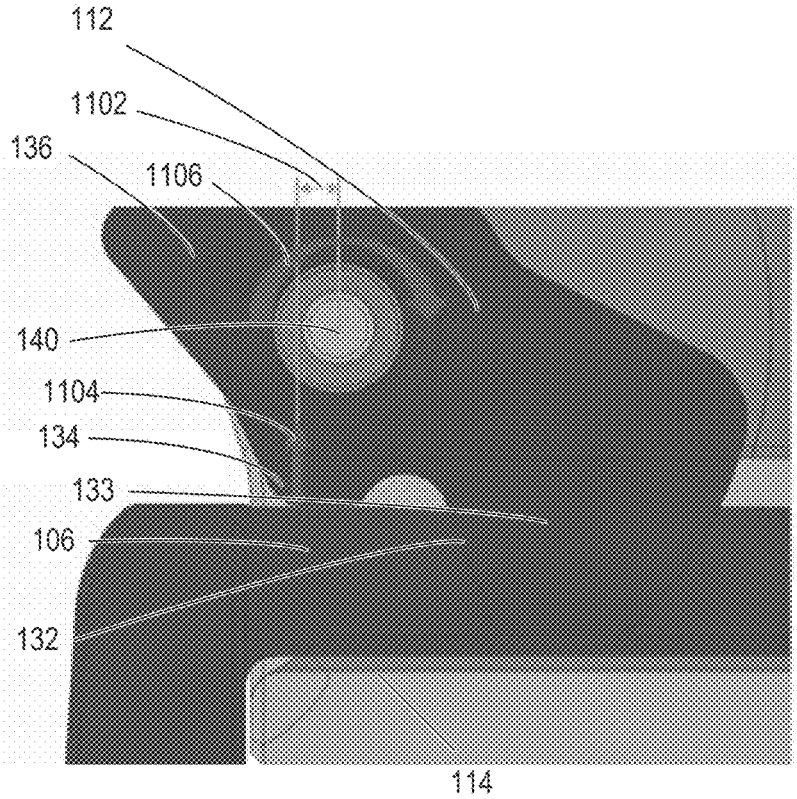
FIG. 11 shows an embodiment of a lobe of a cam latch of an articulating buckle producing a pivoting force towards a locked position in the cam latch. The figures are drawn to scale, although other relative proportions may be used, if desired.

Turning to FIG. 10A, articulating buckle 100 is shown in a first position, wherein cylindrical bar 106 is fully disengaged from hook 114. FIG. 10A illustrates that the loop side 102 and the hook side 104 of articulating buckle 100 may be engaged while in a range of relative orientations. For example, as shown in FIG. 10A, loop side 102 is pivoted approximately 35 degrees relative to hook side 104. Loop side 102 and hook side 104 may be engaged with various degrees of relative pivoting, enabled by the engagement mechanism of articulating buckle 100. In this way, a user may more easily engage the two halves of articulating buckle 100, as a larger range of relative conformations of the loop side 102 and hook side 104 of articulating buckle 100 may be engaged than in a conventional buckle.

Turning to FIG. 10B, articulating buckle 100 is shown in a second position, wherein downward force (that is, force exerted toward a central axis of rounded groove 115 in hook 114) exerted by cylindrical bar 106 onto first outer surface 121 of first cam latch 110 and second outer surface 133 of second cam latch 112, has caused first latch 120 of first cam latch 110 and second latch 132 of second cam latch 112, to partially recede into the recess between cover 116 and base 118. In other words, first cam latch 110 and second cam latch 112 have pivoted to a partially unlocked position, wherein the opening of rounded groove 115 is partially open and partially occluded.

Turning to FIG. 10C, articulating buckle 100 is shown in a third position, wherein continued downward progress of cylindrical bar 106 has produced a force in both first cam latch 110 and second cam latch 112, causing both the first cam latch 110 and the second cam latch 112 to pivot to the unlocked position, wherein the first latch 120 and the second latch 132, are removed from occluding the opening of rounded groove 115, and reside within the recess between cover 116 and base 118.

Turning to FIG. 10D, articulating buckle 100 is shown in a fourth position, wherein cylindrical bar 106 is locked in pivotable engagement with rounded groove 115. First cam latch 110 and second cam latch 112 have pivoted back to the locked position as a result of the resilient biasing force produced by first spring 130 and second spring 142, respectively. In the conformation shown in FIG. 10D, loop side 102 may pivot about a central axis of cylindrical bar 106 (and a central axis of rounded groove 115), while cylindrical bar 106 is inhibited from egressing hook 114 by both the first cam latch 110 and the second cam latch 112. Disengagement of loop side 102 from hook side 104 may necessarily comprise actuation of both first cam latch 110 and second cam latch 112 to the unlocked position (the position shown in FIG. 10C) prior to removal of cylindrical bar 106 from rounded groove 115 by passing the cylindrical bar 106 through the top opening of rounded groove 114.

It will be appreciated, that actuation from the first position, depicted in FIG. 10A to the fourth position depicted in FIG. 10D, may occur in substantially a single actuation (specifically, downward pressure of cylindrical bar 106 against first outer surface 121 and second outer surface 133), whereas actuation from the fourth position depicted in FIG. 10D, to the first position depicted in FIG. 10A, may necessarily comprise actuating the first cam latch 110 and the second cam latch 112 within the hook side 104 of the articulating buckle 100 from a locked position to an unlocked position by pulling both a first release tab 124 of the first cam latch 110 and a second release tab 136 of the second cam latch 112, towards the loop side 102 of the articulating buckle 100 until both the first cam latch 110 and the second cam latch 112 are in an unlocked position, and lifting cylindrical bar 106 of the loop side 102 from a hook 114 of the hook side 104, while maintaining the first cam latch 110 and the second cam latch 112 in the unlocked position. Wherein the loop side 102 of the articulating buckle 100 is pivotable about the cylindrical bar 106 relative to the hook side 104 of the articulating buckle 100 while the loop side 102 is engaged with the hook side 104.

FIG. 11 illustrates how second lobe 134 may produce a torque in second cam latch 112 towards the locked position when cylindrical bar 106 presses against second lobe 134, while the cylindrical bar 106 is within hook 114. Second lobe 134 is offset from an axis of rotation of second cam latch 112, wherein the offset is illustrated graphically by double sided arrow 1102. As second lobe 134 is positioned towards an outside of hook side 104 relative to the axis of rotation of second cam latch 112, contact between second lobe 134 and cylindrical bar 106 (while the cylindrical bar 106 is within the rounded groove 115 of hook 114), produces a force against second lobe 134 in a direction substantially perpendicular to the direction of extension of a central axis of cylindrical bar 106, shown by arrow 1104, this force then results in a torque about second fastener 140, depicted by curved arrow 1106, in the direction of the closed position (note that if second cam latch 112 were to pivot in the direction of arrow 1106, second latch 132 would be pressed further over the opening of hook 114, thereby inhibiting egress of cylindrical bar 106 from rounded groove 115. In this way, random vibration/movement of cylindrical bar 106 is less likely to unintentionally actuate second cam latch 112 to the unlocked position, and therefore unintentional decoupling of loop side 102 from hook side 104 is inhibited.

When introducing elements of various embodiments of the present disclosure, the articles "a," "an," and "the" are intended to mean that there are one or more of the elements. The terms "first," "second," and the like, do not denote any order, quantity, or importance, but rather are used to distinguish one element from another. The terms "comprising," "including," and "having" are intended to be inclusive and mean that there may be additional elements other than the listed elements. As the terms "connected to," "coupled to," etc. are used herein, one object (e.g., a material, element, structure, member, etc.) can be connected to or coupled to another object regardless of whether the one object is directly connected or coupled to the other object or whether there are one or more intervening objects between the one object and the other object. In addition, it should be understood that references to "one embodiment" or "an embodiment" of the present disclosure are not intended to be interpreted as excluding the existence of additional embodiments that also incorporate the recited features.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, the examples and embodiments, in all respects, are meant to be illustrative only and should not be construed to be limiting in any manner.

The invention claimed is:

1. An articulating buckle comprising:

a loop side comprising a cylindrical bar; and a hook side comprising;

a base;

a hook comprising a rounded groove for engaging with the cylindrical bar;

a first cam latch for securing the cylindrical bar within the rounded groove, wherein the first cam latch is pivotably coupled to the base; and a second cam latch for securing the cylindrical bar within the rounded groove, wherein the second cam latch is pivotably coupled to the base;

wherein the first cam latch and the second cam latch secure the cylindrical bar within the rounded groove while in a locked position, wherein the hook side is pivotable about the cylindrical bar relative to the loop side while the cylindrical bar is engaged within the rounded groove, wherein the first cam latch comprises a first lobe, wherein the first lobe is offset from a first fastener receiving hole in the first cam latch, wherein the first lobe produces a first rotational force on the first cam latch towards the locked position when the first lobe is acted against by the cylindrical bar, wherein the second cam latch comprises a second lobe, wherein the second lobe is offset from a second fastener receiving hole in the second cam latch, and wherein the second lobe produces a second rotational force on the second cam latch towards the locked position when acted against by the cylindrical bar.

2. The articulating buckle of claim 1, wherein the first cam latch comprises a first release tab and the second cam latch comprises a second release tab, and wherein the first cam latch and the second cam latch are actuable from the locked position to an unlocked position by actuation of the first release tab of the first cam latch and the second release tab of the second cam latch.

3. The articulating buckle of claim 2, wherein the first release tab extends from a first side of the hook side of the articulating buckle, and wherein the second release tab extends from a second side of the hook side of the articulating buckle, wherein the first side is positioned opposite the second side.

4. The articulating buckle of claim 3, wherein the first release tab and the second release tab are actuable via a thumb and index finger of a single hand of a user.

5. The articulating buckle of claim 1, wherein the first cam latch and the second cam latch are each independently pivotable relative to the hook side.

6. The articulating buckle of claim 5, wherein the first cam latch is pivotable from the locked position to an unlocked position by actuation of a first release tab, and wherein the second cam latch is pivotable from the locked position to the unlocked position by actuation of a second release tab, wherein disengaging the cylindrical bar from the rounded groove necessarily comprises pivoting both the first cam latch and the second cam latch to the unlocked position by actuation of the first release tab and the second release tab.

7. The articulating buckle of claim 1, wherein the first cam latch is resiliently biased towards the locked position by a first spring, and wherein the second cam latch is resiliently biased towards the locked position by a second spring.

8. The articulating buckle of claim 1, wherein the first cam latch comprises a first latch with a first outer surface, and wherein the second cam latch comprises a second latch with a second outer surface, wherein the first outer surface and the second outer surface are sloped to produce a rotational force in the first cam latch and the second cam latch towards an open position when pressed against by the cylindrical bar.

9. A method for disengaging and engaging an articulating buckle comprising:

disengaging a loop side of the articulating buckle from a hook side of the articulating buckle by:

actuating a first cam latch and a second cam latch within the hook side of the articulating buckle from a locked position to an unlocked position by:

pulling both a first release tab of the first cam latch and a second release tab of the second cam latch, towards the loop side of the articulating buckle until both the first cam latch and the second cam latch are in the unlocked position; and removing a cylindrical bar of the loop side from a hook of the hook side, while maintaining the first cam latch and the second cam latch in the unlocked position;

wherein the loop side of the articulating buckle is pivotable about the cylindrical bar relative to the hook side of the articulating buckle while the loop side is engaged with the hook side.

10. The method of claim 9, the method further comprising:

engaging the loop side of the articulating buckle with the hook side of the articulating buckle by:

pressing the cylindrical bar of the loop side against a first outer surface of the first cam latch and a second outer surface of the second cam latch towards a rounded groove of the hook side, inducing the first cam latch and the second cam latch to pivot from the locked position to the unlocked position; and inserting the cylindrical bar into the rounded groove of the hook of the hook side, wherein upon insertion of the cylindrical bar into the rounded groove, the first cam latch and second cam latch return to the locked position.

* * * * *